United States Patent [19]

Regan et al.

[11] 4,019,465

[45] Apr. 26, 1977

[54] FURNACE DESIGN FOR PULVERIZED COAL AND STOKER FIRING

[75] Inventors: John William Regan, Windsor; Douglas Michael Rode, Newington, both of Conn.

[73] Assignee: The Air Preheater Company, Inc., Wellsville, N.Y.

[22] Filed: May 17, 1976

[21] Appl. No.: 687,276

[52] U.S. Cl. ..... 122/240 A; 110/10; 110/23; 122/2

[51] Int. Cl.[2] ..... F22B 31/00; F23G 5/08

[58] Field of Search ..... 122/2, 235 V, 240 R, 122/240 A; 110/10, 23, 28 E, 40

[56] References Cited

UNITED STATES PATENTS

| | | | |
|---|---|---|---|
| 2,239,341 | 4/1941 | Rehm | 122/235 V |
| 2,668,521 | 2/1954 | Beecher | 122/2 |
| 2,876,716 | 3/1959 | Blundin | 110/40 R |
| 3,393,652 | 7/1968 | Connell | 122/2 |

*Primary Examiner*—Kenneth W. Sprague
*Attorney, Agent, or Firm*—Wayne H. Lang

[57] ABSTRACT

A boiler furnace that is adapted to burn slag producing pulverized coal in suspended form at the upper end of the furnace in which solid fuel is being burned on a subjacent grate. The boiler furnace has an upright combustion chamber with baffles intermediate the upper portion of the furnace and the grate to effectively arrest slag that falls from the upper portion of the furnace before it reaches the subjacent grate.

5 Claims, 1 Drawing Figure

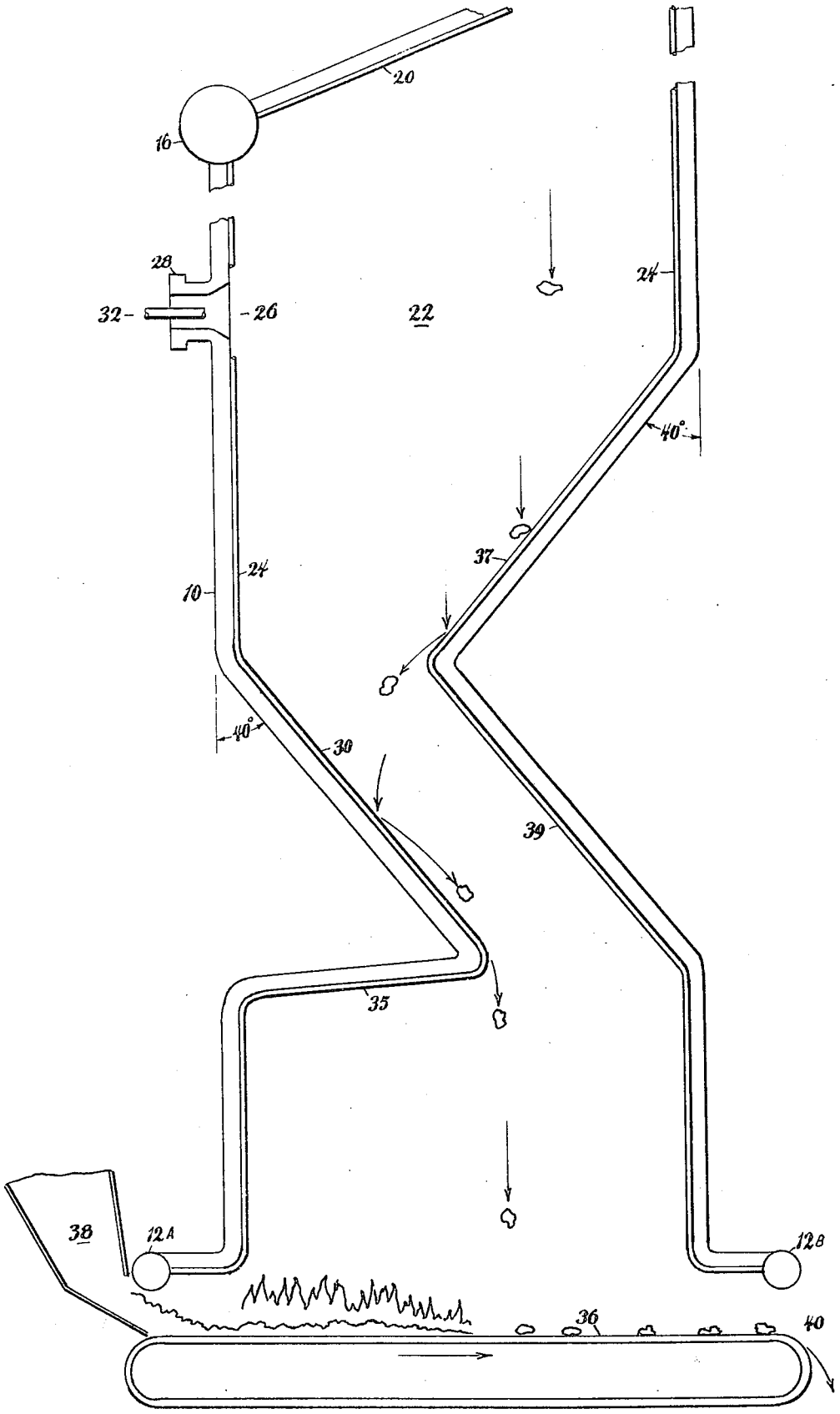
20
16
28
32
26
22
24
40°
37
24
10
40°
30
39
35
38
12A
12B
36
40

FURNACE DESIGN FOR PULVERIZED COAL AND STOKER FIRING

BACKGROUND OR THE INVENTION

This invention relates to boiler furnaces having a bottom positioned grate on which wood bark or the like is burned, while slag producing fuel such as pulverized coal is simultaneously burned in suspension as it is projected from one or more burners located at the side of the boiler furnace and above the grate. When ash resulting from burning coal is subjected to high boiler temperatures it becomes fused and is carried by the gases toward the outlet thereof where it may adhere to furnace walls or other surfaces exposed to high gas temperatures.

Impingement of this fused ash upon a furnace wall results in its cooling and solidification that can cause the formation of heavy layers of dense slag on the furnace walls. Large accumulations of ash or slag eventually break loose and fall to the grate of the stoker to cause physical damage thereto and disturb the burning process that is being effected thereon.

As a result of the present energy crisis a growing number of pulp mills and the like are finding it economical to install bark-fired boilers. At the same time they are finding it advantageous to use pulverized coal as a primary fuel, but for reasons above outlined, the simultaneous use of a coal burner and a stoker has a potential for extreme stoker damage, ineffective combustion, and frequent forced outages that result in a low boiler efficiency.

The present invention is therefore directed towards providing a pulverized coal fired boiler with a subjacent movable grate that can operate simultaneously without the harmful effects caused by accumulations of heavy fused ash and slag falling onto the surface of the movable grate.

SUMMARY OF THE INVENTION

According to the present invention a boiler-furnace is provided with an upright combustion chamber having an intermediate hopper-like baffle that precludes ash and slag deposits generated by a pulverized coal burner from becoming dislodged from surfaces at the top of the boiler and falling completely down to the movable grate at the bottom of the furnace thereby causing damaging results thereto. It, therefore, becomes a principle object of this invention to provide a furnace design that simultaneously permits the burning of slag producing pulverized coal in suspension and the burning of wood bark or the like on a movable bed type stoker.

It is a further object of this invention to provide a boiler furnace having an upright combustion chamber with a hopper-shaped bottom adapted to intercept falling ash and slag and then direct it to the discharge end of a subjacent stoker where it will not interfere with combustion of fuel on the upper surface thereof.

For a better understanding of the invention, its operating advantages and other objects thereof, reference may be made to the accompanying drawings and description that relates to a preferred embodiment thereof wherein the single FIGURE is a diagrammatic representation of a cross-sectional view of the furnace construction.

DESCRIPTION OF A PREFERRED EMBODIMENT

The embodiment illustrated in the drawing comprises a steam boiler 10, having a pair of transverse lower headers 12A, 12B and steam drums 16 that are connected together by tubes 20 and 24 to permit the circulation of fluid therebetween.

Beneath the tubes 20 and intermediate side walls of the boiler there is formed a combustion chamber 22 having a front wall with a burner opening 26 through which a burner 28 is adapted to exhaust hot products of combustion that result from the combustion of pulverized coal being supplied from a suitable source 32.

Along the bottom of the furnace there is provided a movable stoker 36 having an upper surface that is supplied with a quantity of bark, wood refuse or other solid fuel by gravity flow from a feeder 38 adjacent the forward or supply end of the stoker. The upper run of the stoker is arranged to travel rearwardly toward a discharge end 40 of the stoker where ash and other combustion products may be discharged.

When pulverized coal from burner 28 is burned in the upper part of chamber 22, there is formed a quantity of ash and molten slag that is entrained in the combustion gas stream and solidifies on tubes 20 and 24 at the outlet end of the boiler. As combustion and slag buildup continues, accumulations of heavy slag may break loose and fall down to the stoker below on which wood refuse is being burned. Inasmuch as the fused ash or slag that falls onto the stoker is extremely heavy, and it falls as large solid chunks, there exists a very substantial danger of physical damage being done to the stoker. Moreover, the combustion process being carried out on the upper surface of the stoker will be interrupted so that the simultaneous burning of wood products on a grate and the burning of pulverized coal in suspension has not proved practical.

According to this invention, the front and rear tubes that comprise the upright walls of the combustion chamber are reversely bent to a hopper-shaped configuration that forms a baffle immediately above the stoker. The baffle serves to effectively arrest all falling accumulations of slag that break loose from the upper portions of the boiler and fall down to the stoker at the bottom of the boiler.

In effecting this arrangement, the wall tubes 24 that comprise the front wall of the boiler intermediate the burner 28 and the stoker 36 are inclined uniformly inward at approximately 40°, for a distance of about one-half of the width of combustion chamber 22 to comprise the tubes of a front wall 30 of a hopper-shaped chamber. The lower ends of the inclined tubes are reversely bent in the manner shown at 35 to form a protective arch over the forward end of stoker 36 that connects with lower header 12A to provide communication between header 12A and drum 16 to provide for the circulation of fluid therebetween.

The back wall of the boiler extends vertically down from drum 16 and then is inclined inward as at 37 at approximately 40° to form a hopper-shaped baffle that lies intermediate the top and the bottom ends of the boiler at the rear portion thereof.

The tubes forming baffle 37 are inclined inwardly across what is approximately one-half the boiler, at which point they are given a reverse bend 39 forming a rear wall inclined outwardly at an angle similar to wall 30 of the baffle. The tubes then are bent again to form a vertical connection to header 12B whereby there may be free communication of fluid in the tubes and header with the interior of drum 16.

In operation, it will be apparent from the above disclosure that ash and slag falling down from the upper tubes 20 will be arrested by inclined baffles 30 or 37. As ash and slag descend over these surfaces they finally drop to the stoker below, but they only fall a relatively short distance where they can cause no harm to the stoker, and they drop to the discharge end of stoker 36 adjacent the ash discharge 40 where they will not disturb the combustion of fuel at the forward or supply end of the stoker.

While a preferred embodiment of the present invention has been disclosed herein, it should be understood that this description is merely illustrative and that variations and modifications may be made therein without departing from the spirit and scope of the invention as recited in the appended claims.

We claim:

1. A boiler furnace having upright walls enclosing a vertically disposed combustion chamber, a burner for pulverized coal in one of said walls adapted to project fuel for combustion into said chamber, means providing a supply of pulverized coal to said burner, a grate at the bottom of said chamber movable to define an entrance end and a discharge end for a quantity of fuel thereon, means supplying a quantity of fuel to the entrance end of said grate, and baffle means having inclined sides that flank a transverse opening intermediate the coal burner and the movable grate arranged to intercept solid products of combustion falling from the upper end of said boiler to the grate below.

2. A boiler furnace having upright walls enclosing a vertical combustion chamber as defined in claim 1 wherein the inclined sides of said hopper means intermediate the coal burner and the movable grate extend substantially across the combustion chamber.

3. A boiler furnace with upright walls enclosing a vertical combustion chamber as defined in claim 1 having an arch connecting the lower end of a baffle to the furnace wall to form a reflective cover over the entrance end of the movable grate to enhance the combustion process thereon.

4. A boiler furnace having upright walls enclosing a vertical combustion chamber as defined in claim 1 wherein the baffle means intermediate the coal burner and the movable grate includes water circulation means therein that precludes the adherence of molten slag thereto.

5. A boiler furnace having upright walls enclosing a vertical combustion chamber as defined in claim 1 wherein the transverse opening of said hopper lies adjacent the discharge end of the movable grate to preclude the interference of falling slag with combustion of material at the entrance end of said grate.

* * * * *